US006948405B1

(12) United States Patent
Simmons

(10) Patent No.: US 6,948,405 B1
(45) Date of Patent: Sep. 27, 2005

(54) LOW PROFILE RATCHET WRENCH

(76) Inventor: Huey P. Simmons, 461 Rocky Branch Dr., Centerville, AL (US) 35042

( * ) Notice: Subject to any disclaimer, the term of this patent is extended or adjusted under 35 U.S.C. 154(b) by 0 days.

(21) Appl. No.: 10/793,038

(22) Filed: Mar. 5, 2004

(51) Int. Cl.[7] ..... B25B 13/46
(52) U.S. Cl. ..... 81/63; 81/62; 81/63.2
(58) Field of Search ..... 81/58, 60–63.2

(56) References Cited

U.S. PATENT DOCUMENTS 228,827 A * 6/1880 Mell ..... 81/63
951,056 A * 3/1910 Clark ..... 81/63
1,177,764 A * 4/1916 Dodge ..... 81/62
2,547,515 A 4/1951 Drey et al.
2,590,387 A * 3/1952 Dodge ..... 81/62
2,808,749 A 10/1957 Lampke
2,851,914 A * 9/1958 Zechzer ..... 81/58.2
3,019,682 A * 2/1962 Hare ..... 81/63.2
4,254,675 A * 3/1981 Marlow et al. ..... 81/63
4,274,311 A * 6/1981 Ebert ..... 81/63
4,277,989 A * 7/1981 Tracy ..... 81/62
4,300,413 A * 11/1981 Garofalo ..... 81/62
4,311,072 A 1/1982 Hudgins
4,336,728 A * 6/1982 Deibert ..... 81/62
4,419,911 A * 12/1983 Claudy ..... 81/62
4,589,307 A * 5/1986 Parker ..... 81/62
4,869,138 A * 9/1989 Farris ..... 81/63
4,907,476 A 3/1990 Singleton
4,967,624 A * 11/1990 Farris ..... 81/63
5,000,066 A * 3/1991 Gentiluomo ..... 81/62
5,201,255 A * 4/1993 Gegg ..... 81/57.29
5,230,262 A * 7/1993 Ahlund et al. ..... 81/63.2
5,582,080 A * 12/1996 Barmore ..... 81/63
5,584,220 A 12/1996 Darrah et al.
5,761,972 A * 6/1998 Sanders ..... 81/60
5,857,390 A 1/1999 Whiteford
6,148,694 A 11/2000 Spirer
6,234,049 B1 5/2001 Ju et al.
6,253,647 B1 * 7/2001 Eggert et al. ..... 81/63
6,330,842 B1 * 12/2001 Brun ..... 81/57.39
6,481,316 B1 * 11/2002 Liao ..... 81/63
6,536,310 B2 3/2003 Goldfein

* cited by examiner

*Primary Examiner*—David B. Thomas
(74) *Attorney, Agent, or Firm*—John D. Gugliotta; Olen L. York, III

(57) ABSTRACT

An improved low profile ratchet wrench comprising a rotatable head and a handle, wherein a lever projecting from the free end of the handle permits selective adjustment of the unidirectional rotation of the ratchet wrench. The lever eccentrically rotates so as to urge a cam and cam teeth to engage the teeth of a ratchet wheel, thereby selecting an appropriate unidirectional path. In use, the unidirectional path may be changed by eccentrically rotating the lever in the opposite direction previously selected, thus permitting reversal of the ratchet head.

2 Claims, 5 Drawing Sheets

LOW PROFILE RATCHET WRENCH

RELATED APPLICATIONS

The present invention contains subject matter that was first described in Disclosure Document Registration 537,684 filed on Sep. 2, 2003 under 35 U.S.C. §122 and 37 C.F.R. §1.14. As such, it is respectfully requested that said Disclosure Document remain a permanent part of the file history of the present application and be relied upon during the pending prosecution, and for any other matters that may arise.

There are no previously filed, nor currently any co-pending applications, anywhere in the world.

BACKGROUND OF THE INVENTION

1. Field of the Invention

The present invention relates generally to a ratchet wrench and, more particularly, to a thin or low-profile ratchet wrench for socket driving or removal having a socket reversing lever projecting from a terminal end of the ratchet wrench handle for adjusting the direction of socket driving or removal.

2. Description of the Related Art

When the automobile industry shifted production emphasis to economy size automobiles, the size of the engine and the concomitant space were significantly reduced. The reduction of size and space has carried over to mid-size and large vehicles. Although the reduction in engine size and space lowered production costs, and ultimately consumer prices, the ability of the do-it-yourself mechanic to perform maintenance on an auto was permanently hindered. The bolts, screws and nuts used on an engine are placed in spaces that are quite difficult to access with ordinary hand tools. Similarly, certified mechanics were required to purchase new tools and spend more time in disassembly and reassembly because of the compact space, increasing the labor costs to consumers. Thus, a need for an inexpensive hand tool appropriately sized to accommodate use in tightly spaced areas is apparent.

A search of the prior art did not disclose any patents that read directly on the claims of the instant invention; however, the following references were considered related:

U.S. Pat. No. 6,536,310, issued in the name of Goldfein, discloses a low profile wrench;

U.S. Pat. No. 6,253,647, issued in the name of Eggert et al., discloses a reversible ratchet with remote reversing operating mechanism;

U.S. Pat. No. 6,234,049, issued in the name of Ju et al., discloses an improved ratchet tool with a swing head that is rotated within a small angle by an eccentric member connected to a rod in the shank;

U.S. Pat. No. 6,148,694, issued in the name of Spirer, discloses a hand wrench with torque augmenting means;

U.S. Pat. No. 5,857,390, issued in the name of Whiteford, discloses a reversible ratchet wrench having an axial opening to allow a bolt to pass through and extend beyond;

U.S. Pat. No. 5,584,220, issued in the name of Darrah et al., discloses an angle attachment tool having a drive element at a remote end to accommodate a power tool;

U.S. Pat. No. 4,907,476, issued in the name of Singleton, discloses a speed socket wrench with a T-shaped turning handle;

U.S. Pat. No. 4,311,072, issued in the name of Hudgins, discloses a speed handle ratchet wrench;

U.S. Pat. No. 2,808,749, issued in the name of Lampke, discloses a gear operated power wrench; and U.S. Pat. No. 2,549,515, issued in the name of Orey et al., discloses a wrench having a pivoted handle and removable socket.

Consequently, there is a need for a thin or low-profile ratchet wrench with a socket reversing lever projecting from an end of the ratchet wrench handle.

SUMMARY OF THE INVENTION

It is therefore an object of the present invention to provide an improved ratchet wrench.

It is a feature of the present invention to provide an improved ratchet wrench having a lever selectively adjustable to set the directional rotation of the ratchet wrench head.

It is a further feature of the present invention to provide an improved ratchet wrench having a lever comprising a drive switch projecting from the free end of the wrench handle, the drive switch depending from a linearly elongated shaft, and a catch terminating the opposing end of the shaft. The catch mechanically communicates and operatively engages a cam.

It is a further feature of the present invention to provide an improved ratchet wrench comprising a cam, the cam having a plurality of cam teeth for engaging a ratchet wheel and ratchet wheel teeth, thereby setting the directional rotation of the ratchet wrench. The cam is bidirectionally pivotal about an axle, the cam urged to impinge with the ratchet wheel and promote unidirectional rotation of the ratchet head. The cam has a pair of margins depending from the inferior end, the margins engaging the catch of the lever, wherein the catch engages a margin and urges the cam in that direction. The cam is impinged in one of the positions via a ball exposed from an outwardly biased spring, the ball inserted into one of two concave hollows formed on the surface of the cam.

Briefly described according to one embodiment of the present invention, an improved low profile ratchet wrench comprising a rotatable head and a handle, wherein a lever projecting from the free end of the handle permits selective adjustment of the unidirectional rotation of the ratchet wrench. The lever eccentrically rotates so as to urge a cam and cam teeth to engage the teeth of a ratchet wheel, thereby selecting an appropriate unidirectional path. In use, the unidirectional path may be changed by eccentrically rotating the lever in the opposite direction previously selected, thus permitting reversal of the ratchet head.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS. 1–5*c*.

1. Detailed Description of the Figures

Referring now to FIG. 1 through FIG. 4, a thin or low-profile ratchet wrench 10 is shown in accordance with a preferred embodiment of the present invention. The ratchet wrench 10 comprises a head 12, a linearly elongated handle 14 and a lever 16 projecting from the free end of the handle 14. The lever 16 is selectively adjustable and permits the user to change the rotational direction of the ratchet wrench 10 without having to remove the ratchet wrench 10 from a fastener.

Figure 1:
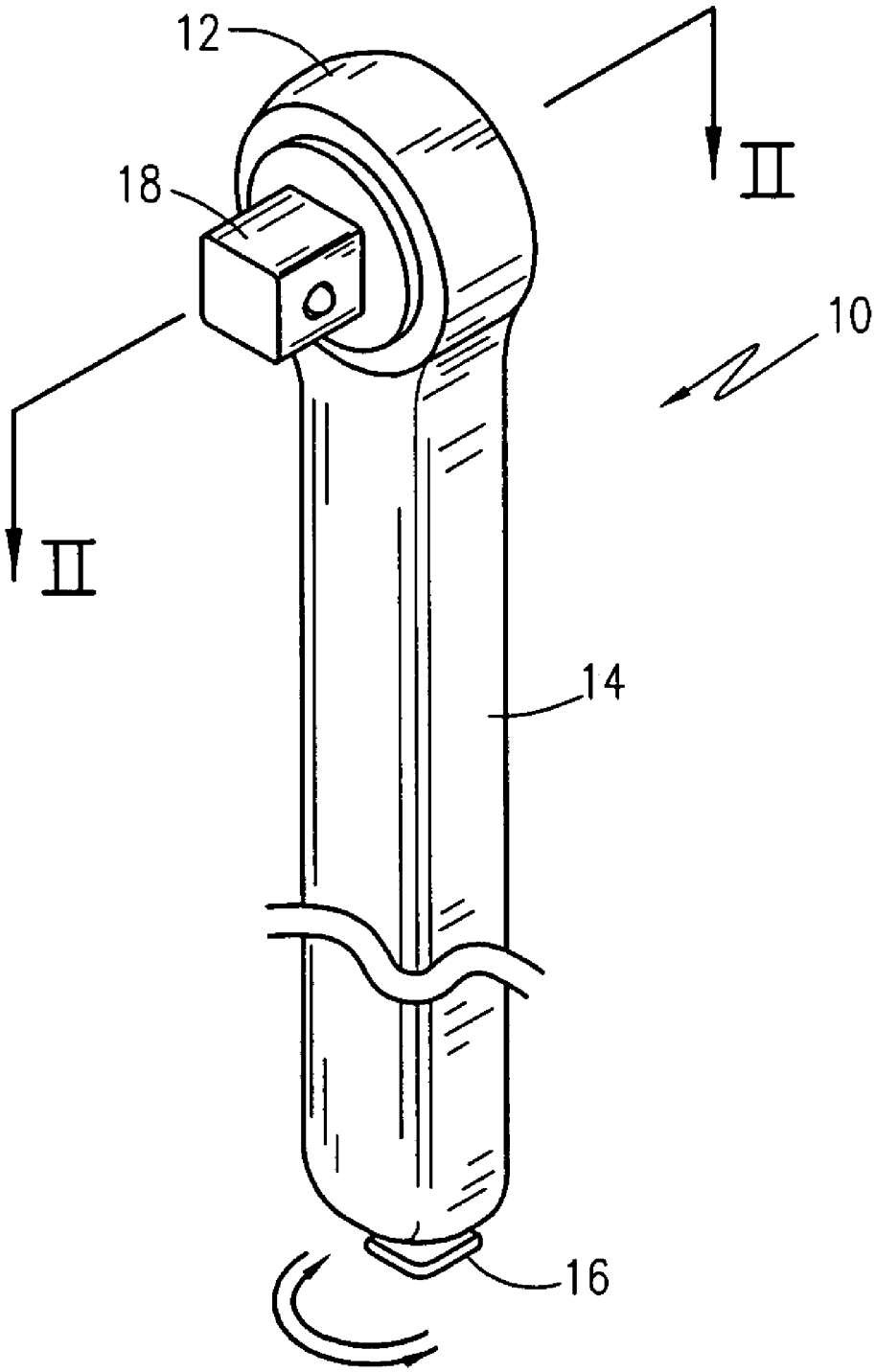
FIG. 1 is a perspective view of a low profile ratchet wrench.
Figure 2:
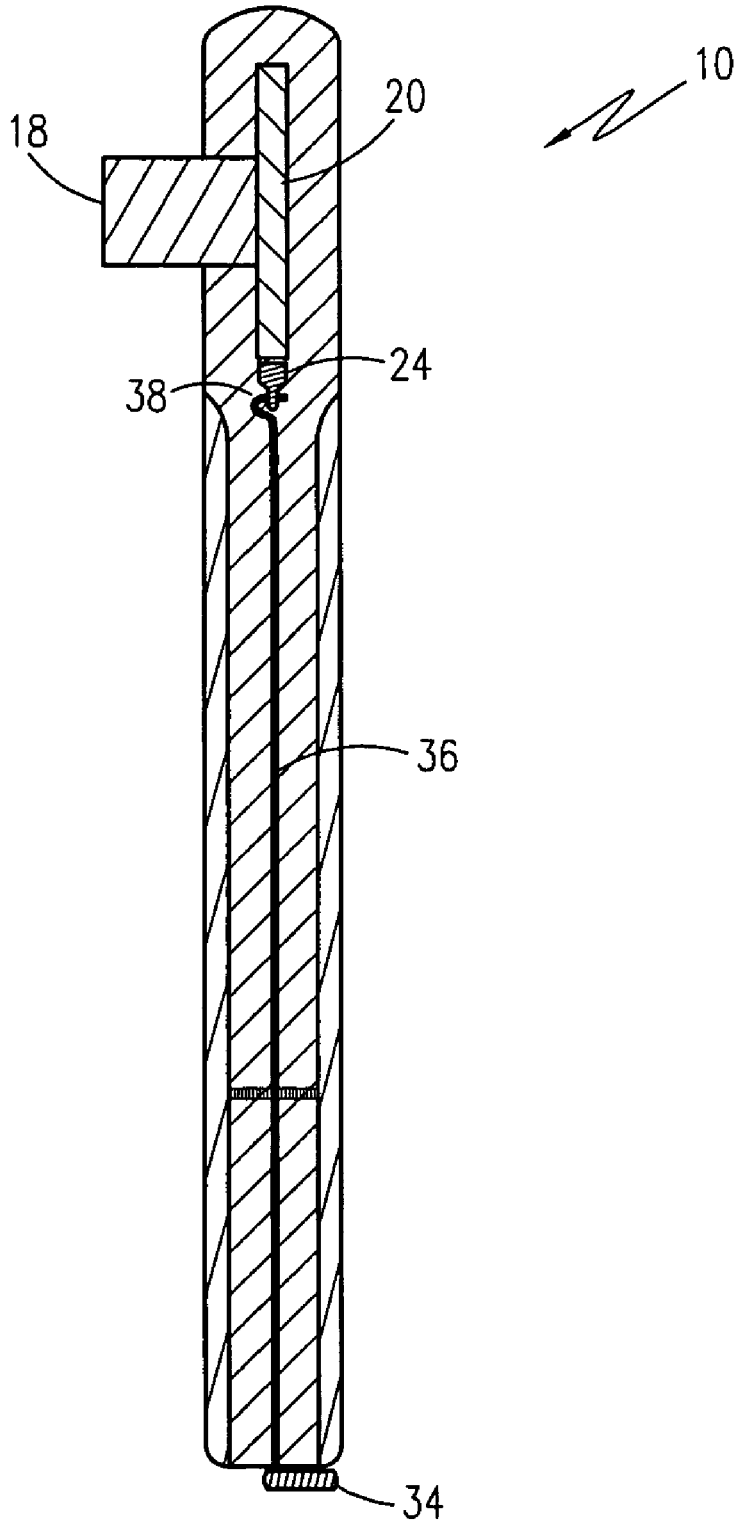
FIG. 2 is a cross-sectional view of the ratchet wrench taken along line II—II of FIG. 1.
Figure 3:
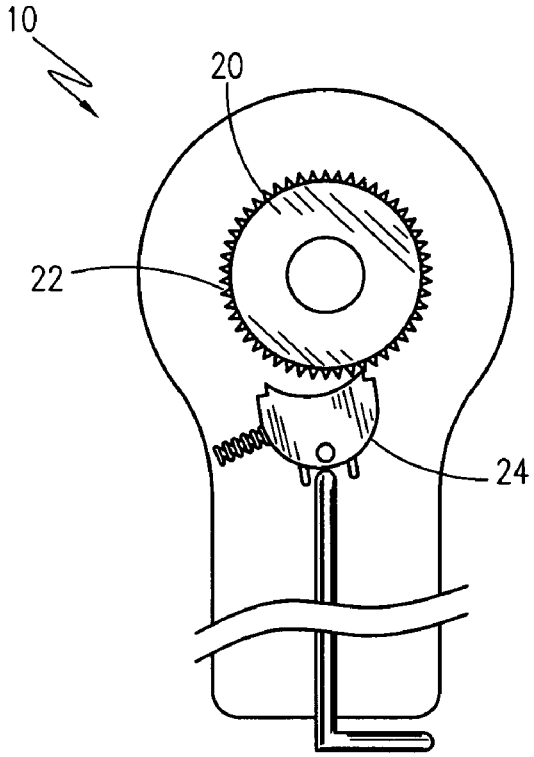
FIG. 3 is a front view of the ratchet wrench with a portion partially removed to expose the socket reversing lever and a cam for adjusting the direction.
Figure 4:
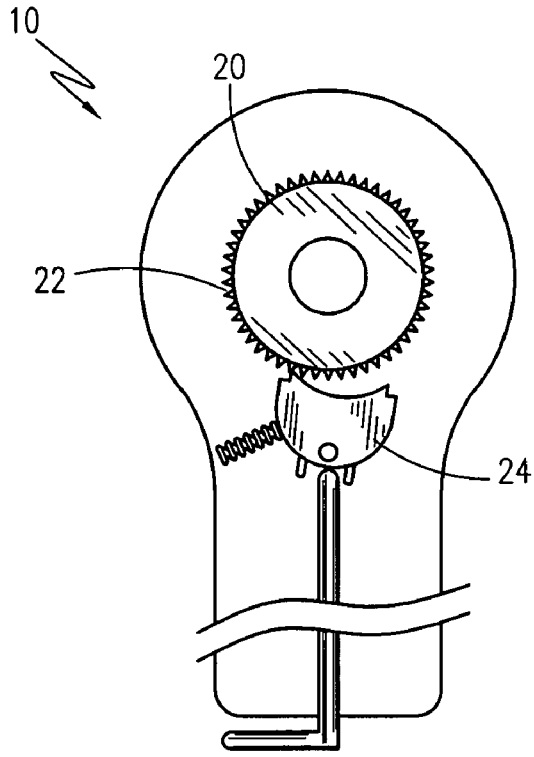
FIG. 4 is a front view of the ratchet wrench similar to FIG. 3, wherein the cam is adjusted in the opposite direction of the cam in FIG. 3.

The head 12 includes a ratchet socket driving shaft 18 (hereinafter "driving shaft") for attachment with an appropriately sized driving socket (not shown) selectively chosen to drive or remove a correspondingly sized fastener (such as a bolt, for example). As best illustrated in FIG. 2 through FIG. 4, the head 12 includes a rotatable ratchet wheel 20 depending from the rear of the driving shaft 18 and internally housed by the head 12. The ratchet wheel 20 urges the driving shaft 18 along a unidirectional rotation path depending upon the directional selection of the lever 16 and the corresponding rotational or radial displacement of the handle 14, the details of which are discussed below. The ratchet wheel 20 comprises a plurality of ratchet wheel teeth 22 circumscribing the circumference of the ratchet wheel 20. The teeth 22 are provided to engage a pivotal cam 24 and the corresponding cam teeth 26 provided thereon, thereby permitting only unidirectional rotation of the ratchet wheel 20 and the dependent driving shaft 18.

The cam 24 comprises a plurality of cam teeth 26 engaging the ratchet wheel teeth 22, a first margin 28 and a second margin 30 each depending from an inferior end of the cam 24 and separated by a distance. The first margin 28 and the second margin 30 are provided to operatively communicate or engage the lever 16. The cam 24 is bidirectionally pivotal about an axle 32, thus allowing the cam teeth 26 to engage the ratchet wheel teeth 22 to inhibit either clockwise or counterclockwise rotation as desired.

The lever 16 comprises a drive switch 34 projecting from the free end of the handle 14, a linearly elongated shaft 36 upstanding or upwardly depending from the drive switch 34 and housed within the handle 14, and a catch 38 depending from the shaft 36 opposite the drive switch 34. The catch 38 engages the first margin 28 and/or the second margin 30 of cam 24. The drive switch 34 is eccentrically rotated for selectively choosing a rotational direction for the ratchet wheel 20 and driving shaft 18. Upon selective rotation of the drive switch 34, the shaft 36 is rotated in the same rotational direction, and thereby causes the catch 38 to rotate as well. As a result, the catch 38 engages and urges the first margin 28 or the second margin 30 along a rotational direction away from the centerline "C—C", thereby urging the cam 24 accordingly along pivotal axle 32. The urging of the cam 24 results in the engagement of the cam teeth 26 with the ratchet wheel teeth 22, thus providing unidirectional rotation thereof.

Figure 5A:
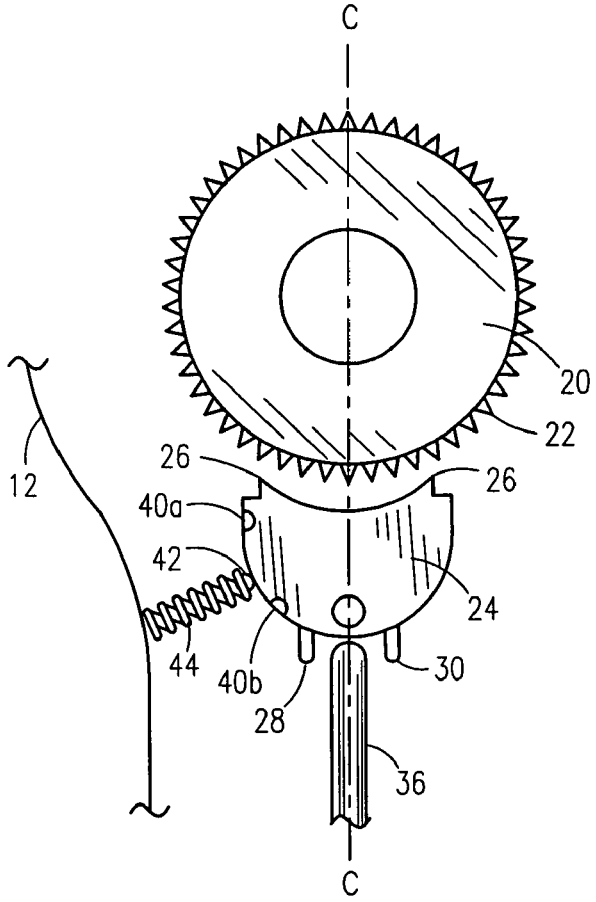
FIG. 5*a* is a magnified front view of the cam in a unengaged position.
Figure 5B:
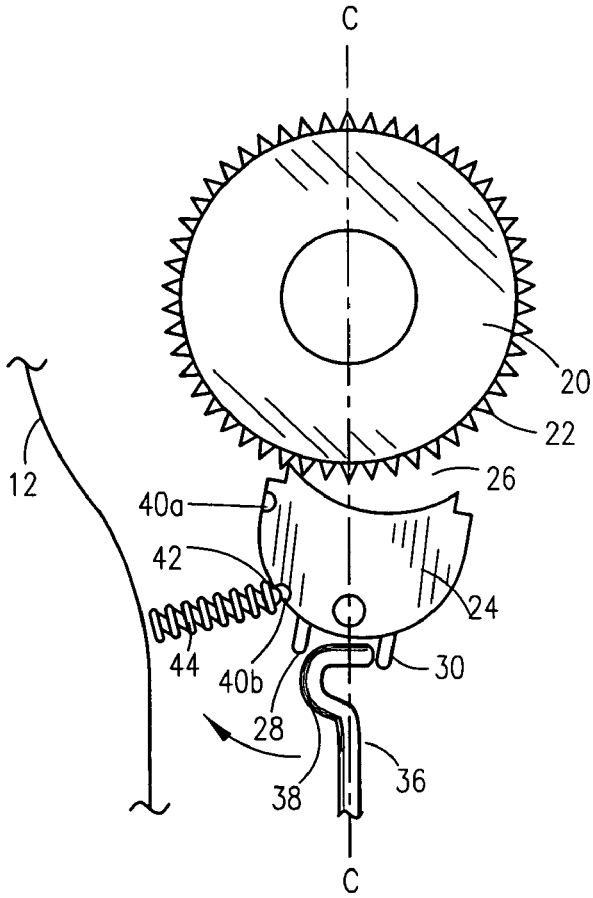
FIG. 5*b* is a magnified front view of the cam engaging the teeth of a ratchet wheel, the cam rotated to the left.
Figure 5C:
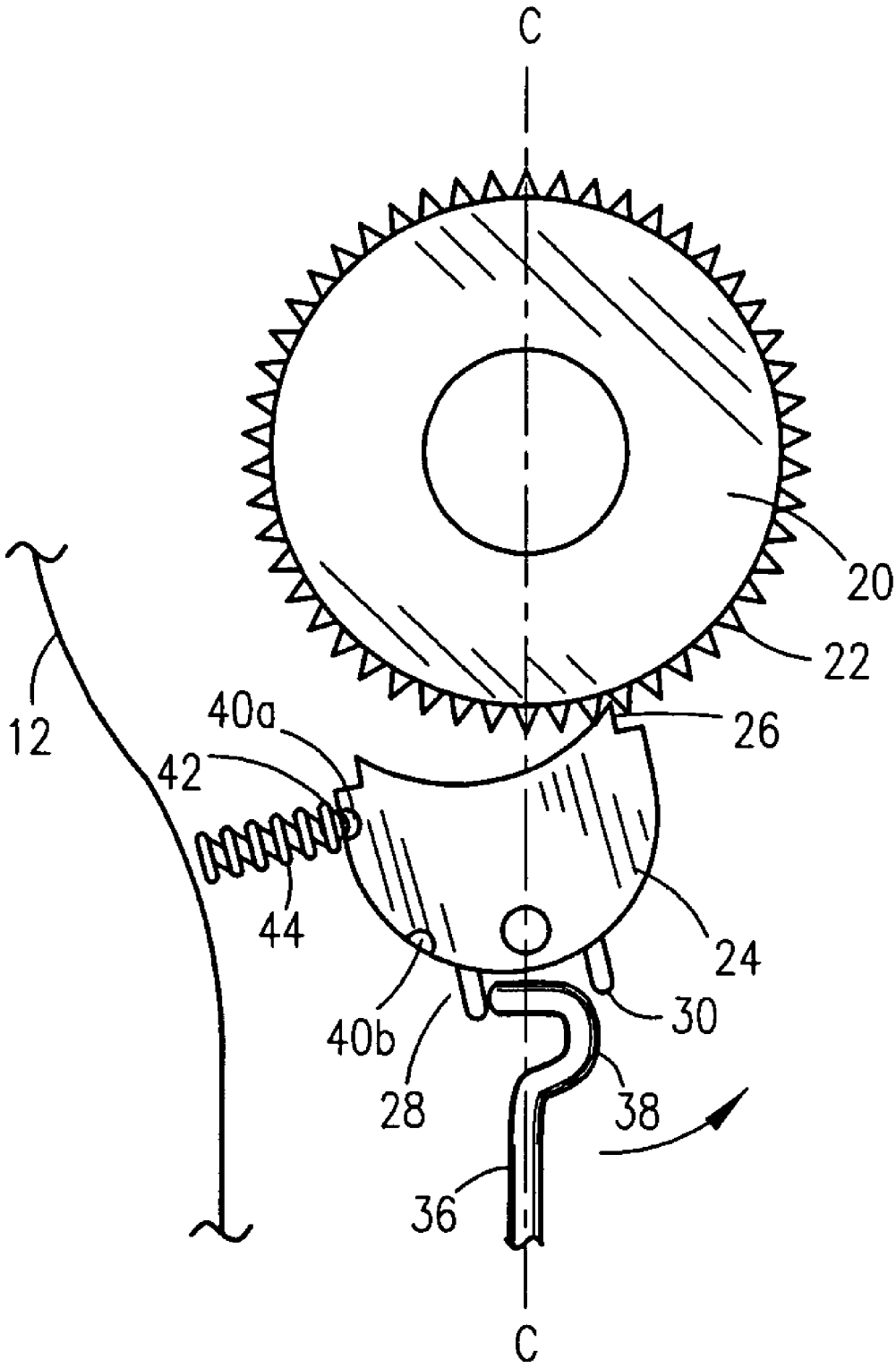
FIG. 5*c* is a magnified front view of the cam engaging the teeth of a ratchet wheel, the cam rotated to the right.

As best seen in FIG. 5*a* through FIG. 5*c*, in order to impinge the cam 24 at a specified position chosen by the user to impart a particular rotational direction on the driving shaft 18, impingement means are provided to securely maintain the unidirectional rotation selected by eccentric rotation of the lever 16. Impingement means (as shown) includes concave hollows 40*a* and 40*b* (concave defined relative to the observer looking into the hollow), and a ball 42 and spring 44. The hollows 40*a* and 40*b* are positioned along the same marginal side and are adjacently spaced, one hollow 40*a* superior to the other hollow 40*b*. The hollows 40*a* and 40*b* are sized to correspond to and accommodate the ball 42. The spring 44 is outwardly biased and is affixed about its end to the inside wall of the head 12. The ball 42 is partially housed in the opposing free end of the spring 44 so that the ball 42 is partially exposed out that free end. As the cam 24 is pivotally urged in either direction (see FIG. 5*b* and FIG. 5*c*, respectively), the ball 42 will insert into either one of the appropriate hollows 40*a* or 40*b* (depending upon which direction the cam 24 is pivotally urged). The outward bias of spring 44 will firmly impinge the ball 42 within the appropriate hollow 40*a* or 40*b*. The impingement of the cam 24 (via the hollows 40*a* or 40*b*, the ball 42 and spring 44) is overcome by sufficient force applied to the catch 38 to release engagement between the catch 38 and the margin 28 or 30, and permit displacement of the cam 24 in the opposing rotational direction.

2. Operation of the Preferred Embodiment

A user will place an appropriately sized socket onto the ratchet socket driving shaft 18, and then position the socket over the fastener. The user will then eccentrically rotate the lever 16 (by drive switch 34, shaft 36 and catch 38) to set the desired rotational or radial direction that the shaft 18 and socket shall be turned. If the user needs to reverse the directional rotation, the drive switch 34 is eccentrically rotated to selectively position the internal components to reflect directional rotation opposite the previous direction.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. In a low profile ratchet wrench having a head with a ratchet socket driving shaft and a linearly elongated handle depending therefrom, the improved ratchet wrench comprising:

a lever axially projecting from a free end of said handle for selectively choosing the directional rotation of said ratchet driving shaft:

a cam, wherein said lever urges said cam to engage ratchet wheel teeth and allow selective unidirectional rotation of said ratchet socket driving shaft in a direction clockwise or counterclockwise about a fastener;

a plurality of cam teeth engaging said ratchet wheel teeth;

a first margin and a second margin each depending from an inferior end of said cam and separated by a distance, said first margin and said second margin engaged by said lever;

said cam pivotal about an axle;

a pair of concave hollows formed on the surface of said cam, said hollows adjacently spaced on the same marginal side of said cam;

an outwardly biased spring affixed at one end to an interior wall of said head; and a ball partially housed by said spring at an end opposite the affixed end, said ball inserted into one of said hollows to impinge the cam in a specified position, thereby facilitating unidirectional rotation of said ratchet wrench.

2. The ratchet wrench of claim 1, wherein said lever comprises:

a drive switch projecting from the free end of said handle, said drive switch eccentrically rotated to engage said catch with said first margin or said second margin, thereby urging said cam accordingly;

a linearly elongated shaft depending from said drive switch and housed in said handle;

a catch depending from said shaft opposite said drive switch, said catch engaging said first margin and said second margin.

* * * * *